US011864667B1

(12) United States Patent
Zhang

(10) Patent No.: US 11,864,667 B1
(45) Date of Patent: Jan. 9, 2024

(54) FOLDABLE CRIB

(71) Applicant: Xiamen Honor Industry and Trading Co., Ltd., Fujian (CN)

(72) Inventor: Jianyong Zhang, Fujian (CN)

(73) Assignee: XIAMEN HONOR INDUSTRY AND TRADING CO., LTD., Fujian (CN)

( * ) Notice: Subject to any disclaimer, the term of this patent is extended or adjusted under 35 U.S.C. 154(b) by 0 days.

(21) Appl. No.: 18/336,208

(22) Filed: Jun. 16, 2023

(30) Foreign Application Priority Data

Apr. 11, 2023 (CN) ..... 202310379171.9

(51) Int. Cl.
*A47D 9/00* (2006.01)

(52) U.S. Cl.
CPC ..... *A47D 9/005* (2013.01)

(58) Field of Classification Search
CPC ..... A47D 9/005
USPC ..... 5/99.1
See application file for complete search history.

(56) References Cited

U.S. PATENT DOCUMENTS 5,211,498 A * 5/1993 Huang ..... A47D 13/063 5/99.1
5,483,710 A * 1/1996 Chan ..... A47D 13/063 16/326
5,761,755 A * 6/1998 Huang ..... A47D 13/063 5/98.1
5,819,342 A * 10/1998 Williams ..... A47D 13/063 5/98.1
6,202,229 B1 * 3/2001 Cheng ..... A47D 13/063 5/98.1
6,473,919 B1 * 11/2002 Wang ..... A47D 13/063 5/98.1
6,510,568 B1 * 1/2003 Drobinski ..... A47D 13/063 5/99.1
6,510,569 B1 * 1/2003 Hu ..... A47D 13/063 5/99.1
6,568,004 B1 * 5/2003 Sun ..... A47D 7/002 5/99.1
6,634,039 B1 * 10/2003 Cheng ..... A47D 13/063 5/99.1
6,725,475 B1 * 4/2004 Chen ..... A47D 13/063 5/98.1
7,694,361 B1 * 4/2010 Chen ..... A47D 13/063 5/98.1

(Continued)

*Primary Examiner* — Justin C Mikowski
*Assistant Examiner* — Luke Hall
(74) *Attorney, Agent, or Firm* — Cooper Legal Group, LLC

(57) ABSTRACT

A foldable crib includes a side rail and an underframe. The side rail includes foldable horizontal bars. The foldable horizontal bar includes a first locking mechanism and a movable unlocking member. The movable unlocking member has a first unlocking stroke for unlocking the first locking mechanism. The underframe includes a lifting and flipping mechanism. The lifting and flipping mechanism includes a second locking mechanism and a handle. The handle has a second unlocking stroke for unlocking the second locking mechanism. The handle is linked with the movable unlocking member through a first linkage structure such that the second unlocking stroke of the handle is capable of causing the first unlocking stroke of the movable unlocking member. A second linkage structure is configured to link the foldable horizontal bar to be unfolded when the underframe is unfolded.

13 Claims, 13 Drawing Sheets

(56) References Cited

U.S. PATENT DOCUMENTS 8,069,533 B2 * 12/2011 Yu ..... A47D 13/063 5/99.1
8,650,678 B2 * 2/2014 Thorne ..... A47D 13/061 5/98.1
8,943,622 B2 * 2/2015 Saint ..... A47D 13/06 5/99.1
2006/0021136 A1 * 2/2006 Cheng ..... A47D 13/063 5/99.1
2006/0021137 A1 * 2/2006 Waldman ..... A47D 13/063 5/99.1
2006/0225208 A1 * 10/2006 Chen ..... A47D 13/063 5/99.1
2007/0186344 A1 * 8/2007 Cheng ..... A47D 13/063 5/99.1
2009/0172879 A1 * 7/2009 Hsu ..... A47D 13/063 5/99.1
2009/0188040 A1 * 7/2009 Cheng ..... A47D 13/063 5/99.1
2009/0193581 A1 * 8/2009 Cheng ..... A47D 13/063 5/99.1
2009/0260156 A1 * 10/2009 Yu ..... A47D 13/063 5/99.1
2009/0320205 A1 * 12/2009 Chen ..... A47D 13/063 5/99.1
2010/0218311 A1 * 9/2010 Rivera ..... A47D 13/063 5/99.1
2010/0260536 A1 * 10/2010 Yu ..... A47D 13/063 5/99.1
2011/0232109 A1 * 9/2011 Strader ..... A01D 34/736 30/347
2013/0074257 A1 * 3/2013 Mendes ..... F16C 11/10 16/349
2013/0232688 A1 * 9/2013 Mendes ..... A47D 13/061 5/99.1
2014/0047639 A1 * 2/2014 Cheng ..... A47D 13/063 5/99.1
2015/0272343 A1 * 10/2015 Hung ..... A47D 13/061 5/99.1
2019/0142183 A1 * 5/2019 Mountz ..... A47D 13/063 5/99.1
2019/0335917 A1 * 11/2019 Taylor ..... A47D 9/016
2020/0281369 A1 * 9/2020 Juchniewicz ..... A47D 7/002
2021/0137280 A1 * 5/2021 Villano ..... A47D 15/008
2023/0180945 A1 * 6/2023 Thorne ..... A47D 13/063 5/99.1

* cited by examiner

FOLDABLE CRIB

CROSS-REFERENCE TO RELATED APPLICATION

This application claims priority to Chinese Patent Application 202310379171.9, filed on Apr. 11, 2023, which is incorporated herein by reference.

TECHNICAL FIELD

The disclosure relates to the technical field of crib manufacturing, and in particular to a foldable crib that can be folded or unfolded in one step.

BACKGROUND

Cribs are common equipment in the field of infant care. A common existing crib frame structure is shown in FIG. 1. The frame part of the crib includes an underframe 200 and a side rail 100. The underframe 200 serves as a bottom support. The side rail 100 includes vertical bars 102 vertically connected to the underframe 200, and foldable horizontal bars 101 each connected between the vertical bar 102 and the vertical bar 102 so as to form a closed rail structure. Foldable cribs are widely used because of their characteristics of easy folding, easy transportation and small occupied space. The underframe 200 and the side rail 100 of the foldable crib are respectively provided with a folding structure, so that the foldable crib can be unfolded and folded. The underframe 200 is typically provided with a lifting and flipping structure 2010 with a handle. When the handle is lifted, underframe bars 2020 of the underframe 200 are flipped up and folded relatively, and the vertical bars 102 of the side rail 100 are pulled close to each other. The foldable horizontal bars 101 of the side rail 100 are typically provided with folding joints 103. With the folding joint 103, the foldable horizontal bar 101 can be folded in half. These structures are common techniques in the field.

In order to prevent the crib from collapsing, the folding joints 103 and the lifting and flipping structure 2010 need to be provided with locking structures, so that both the underframe 200 and the side rail 100 can be locked to stay in the unfolded state when the crib in the unfolded state. Therefore, the existing foldable crib is folded in the following way: When the crib is in the unfolded state, first, the locking structure of the folding joint 103 is manually operated such that the folding joint 103 is unlocked. At this time, the foldable horizontal bars 101 change from the locked state (in which they are horizontal and straight) into a loose unlocked state (in which they are depressed and bent downward) under the action of gravity. Next, the locking structure of the lifting and flipping structure 2010 is manually operated such that the lifting and flipping structure 2010 is unlocked. The handle of the lifting and flipping structure 2010 is pulled up, so that the underframe bars 2020 are flipped up. The underframe bars 2020 pull the vertical bars 102 close to each other, and the foldable horizontal bars 101 between the vertical bar 102 and the vertical bar 102 are folded upward, thereby completing the folding process. The unfolding process of the foldable crib is as follows: When the crib is in the folded state, the lifting and flipping structure 2010 is manually pushed down so as to unfold the underframe bars 2020, the vertical bars 102 and the foldable horizontal bars 101. At this time, the foldable horizontal bars 101 are still in the loose unlocked state. Therefore, it is necessary to manually pull up the folding joint 103 so as to straighten the foldable horizontal bar 101, so that the foldable horizontal bar 101 and the folding joint 103 become locked, thereby finally completing the unfolding process of the crib.

In summary, since the folding joint 103 and the lifting and flipping structure 2010 of the crib in the prior art are independent of each other without linkage relationship, both the folding and unfolding of the crib need at least two steps to operate the crib (respectively operate the lifting and flipping structure 2010 and the folding joint 103). Neither the folding or the unfolding can be completed in one step, so the foldable crib in the prior art is complex to operate.

SUMMARY

Therefore, in view of the above problems, the disclosure provides a foldable crib with an optimized structure, which can be folded or unfolded in one step.

The disclosure is realized by the following technical solutions:

The disclosure provides a foldable crib, including a side rail and an underframe. The side rail includes foldable horizontal bars. The foldable horizontal bar has a first locking mechanism. The first locking mechanism is configured to lock a folding action of the foldable horizontal bar when the foldable crib is unfolded. The underframe includes a lifting and flipping mechanism. The lifting and flipping mechanism has a second locking mechanism, and the second locking mechanism is configured to lock a folding action of the lifting and flipping mechanism when the foldable crib is unfolded. The foldable horizontal bar further includes a movable unlocking member. The movable unlocking member has a first unlocking stroke for unlocking the first locking mechanism. The lifting and flipping mechanism includes a handle. The handle has a second unlocking stroke for unlocking the second locking mechanism. A first linkage structure is further included. The handle is linked with the movable unlocking member through the first linkage structure such that the second unlocking stroke of the handle is capable of causing the first unlocking stroke of the movable unlocking member.

In an example, the side rail further includes a plurality of vertical bars. Each of the foldable horizontal bars is arranged between the vertical bar and the vertical bar, and two ends of the foldable horizontal bar are respectively rotatably connected to one of the vertical bars. The underframe further includes a number of underframe bars corresponding to the number of the vertical bars. Inner ends of the plurality of underframe bars converge and are rotatably connected to the lifting and flipping mechanism, and a lower end of each of the vertical bars is connected to an outer end of one of the underframe bars.

In an example, the first linkage structure is a first pull wire. The first pull wire has an upper end linked with the movable unlocking member and a lower end linked with the handle.

In an example, the second unlocking stroke is a rotation stroke of the handle on a vertical axis, and the first unlocking stroke is a vertical downward sliding stroke of the movable unlocking member, so that when the handle rotates in the second unlocking stroke, the movable unlocking member can be pulled by the first pull wire to slide downward in the first unlocking stroke.

In an example, the lifting and flipping mechanism further includes a sleeve seat and a handle rotating disk. The sleeve seat is a hollow sleeve-like structure and includes a sliding sleeve cavity with an axis extending vertically along an up-down direction. The underframe bars are rotatably connected to the sleeve seat. The handle rotating disk is rotatably fitted in the sliding sleeve cavity, and the handle rotating disk and the handle are coaxially connected such that the handle is rotatable along the vertical axis.

In an example, the second locking mechanism includes a lockpin, a lockpin guide seat and an elastic restoring member. The lockpin guide seat is closely arranged to a lower end of the handle rotating disk, and the lockpin guide seat is provided with a straight guide groove extending horizontally. The lockpin is slidably fitted in the straight guide groove. An upper end of the lockpin is fixedly provided with a guide post, and the lower end of the handle rotating disk is provided with an arc-shaped guide groove. An outer edge of the arc-shaped guide groove is in the shape of an arc that gradually bends from a radial outer end toward a radial inner end of the handle rotating disk, and the guide post is inserted in the arc-shaped guide groove. A first end of the elastic restoring member acts on the lockpin guide seat, and a second end of the elastic restoring member acts on the lockpin such that the lockpin has a tendency to move radially outward. The sleeve seat is provided with a lockhole that is insertable by the lockpin.

In an example, the lower end of the first pull wire is fixedly connected to the handle/handle rotating disk. Alternatively, the handle rotating disk includes a disk body and a coupling shaft fixed to an end surface of the disk body; the handle and the disk body are coaxially connected through the coupling shaft; the coupling shaft is sleeved with a lifting sleeve; the disk body is provided with a first slope; the lifting sleeve is provided with a second slope; the first slope and the second slope abut against each other to form a slope guide fit such that the lifting sleeve is lifted through the slope guide fit between the first slope and the second slope when the disk body rotates; and the lower end of the first pull wire is fixedly connected to the lifting sleeve.

In an example, the foldable horizontal bar further includes a first folding bar, a second folding bar and a folding joint arranged between the first folding bar and the second folding bar. The folding joint includes a joint base. The first folding bar and the second folding bar are respectively pivoted to left and right ends of the joint base. The movable unlocking member is a slider arranged between the first folding bar and the second folding bar and capable of sliding up and down, and the upper end of the first pull wire is fixedly connected to the slider. In an example, the first locking mechanism includes a first limiting pin and a second limiting pin, and the joint base is provided with a first horizontal slot and a second horizontal slot that extend left and right. The first horizontal slot and the second horizontal slot are respectively close to the first folding bar and the second folding bar and have a left-right symmetry. The slider is provided with a first oblique slot and a second oblique slot that extend obliquely and have a left-right mirror symmetry. The first limiting pin is slidably fitted in both the first horizontal slot and the first oblique slot, and the second limiting pin is slidably fitted in both the second horizontal slot and the second oblique slot, so that the up-and-down sliding of the slider is converted through the first oblique slot and the second oblique slot into the synchronous sliding of the first limiting pin and the second limiting pin away from or close to each other in the left-right direction. The first limiting pin and the second limiting pin are configured to resist and lock relative folding of the first folding bar and the second folding bar.

In an example, the foldable crib further includes a second linkage structure. The second linkage structure is configured to link the foldable horizontal bar to be relatively unfolded when the underframe bars are unfolded.

In an example, the foldable horizontal bar further includes a first folding bar, a second folding bar and a folding joint arranged between the first folding bar and the second folding bar. The second linkage structure includes a rotary linkage member and a second pull wire. The rotary linkage member is rotatably arranged on an outer end of the underframe bar, and the outer end of the underframe bar is movably hinged with the rotary linkage member. The second pull wire is arranged from an upper end to a lower end sequentially along the foldable horizontal bar and the vertical bar. The upper end of the second pull wire is connected to the first folding bar or the second folding bar, and the lower end is fixedly connected to the rotary linkage member, so that when the underframe bars are unfolded, the second pull wire is pulled by the rotary linkage member so as to pull the first folding bar and the second folding bar to be relatively unfolded.

In an example, the foldable crib further includes supports each fixedly connected to the lower end of the vertical bar. The underframe bar is rotatably connected to the support and capable of flipping between a vertical extreme position and a horizontal extreme position with respect to the support. The rotary linkage member is hinged with the support. A first connecting portion and a second connecting portion are respectively arranged on two sides of the hinge point of the rotary linkage member and the support. The first connecting portion is configured to fix the lower end of the second pull wire. The second connecting portion is a strip groove, and the outer end of the underframe bar is hinged in the strip groove.

In an example, the lifting and flipping mechanism further includes a pull-type combination core and a sleeve seat. The sleeve seat is a hollow sleeve-like structure and includes a sliding sleeve cavity with an axis extending vertically along an up-down direction. The pull-type combination core is slidably inserted and fitted in the sliding sleeve cavity in the up-down direction. The handle is arranged on a top end of the pull-type combination core. A peripheral side of the pull-type combination core is provided with a number of racks extending in the up-down direction corresponding to the number of the underframe bars. The inner end of the underframe bar is fixedly connected with an arc-shaped toothed portion. The sleeve seat is provided with a window, and the underframe bar is rotatably connected to the sleeve seat. The arc-shaped toothed portion of the underframe bar extends into an inner cavity of the sleeve seat via the window and correspondingly engages with the rack.

In an example, the pull-type combination core further includes a straight toothed socket, a handle rotating disk, a lockpin guide seat and a lower cover. The handle rotating disk is rotatably fitted in the sliding sleeve cavity. The handle rotating disk includes a disk body and a coupling shaft fixed to an end surface of the disk body. The handle and the disk body are coaxially connected through the coupling shaft. The straight toothed socket is a hollow tubular structure with two open ends. The coupling shaft runs through the straight toothed socket. The lockpin guide seat is arranged on a lower end of the handle rotating disk. The lower cover is arranged on a lower end of the lockpin guide seat. The straight toothed socket, the lockpin guide seat and the lower cover are fixed and connected through a screw. The handle rotating disk is provided with an avoidance groove for the screw to pass through. The racks are fixedly arranged on a periphery of the straight toothed socket.

The disclosure has the following beneficial effects: With the first linkage structure and the second linkage structure, the unfolding and the folding of the foldable crib can be completed by only operating the lifting and flipping mechanism, and there is no need to operate the folding joint. Therefore, the foldable crib can be unfolded or folded in one step, thereby greatly simplifying the manual operation for the crib.

DESCRIPTION OF EMBODIMENTS

Figure 1:
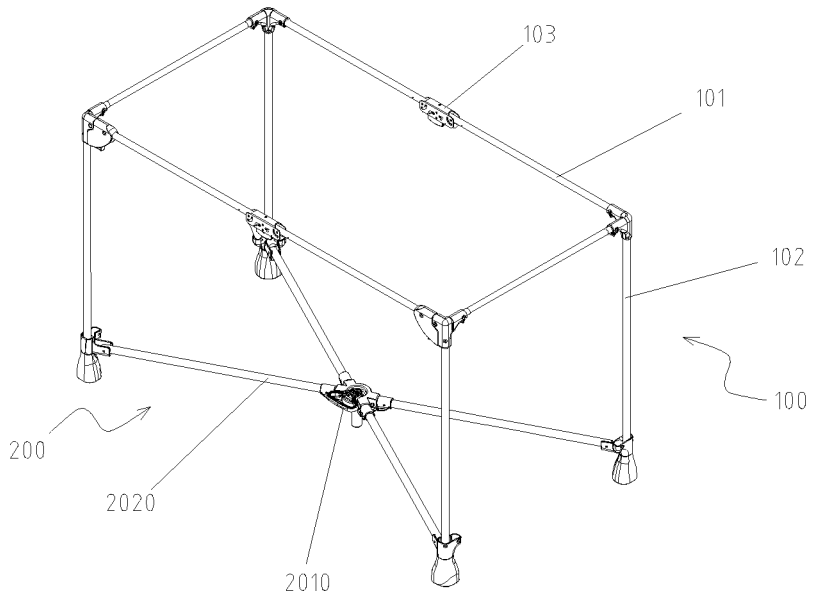
FIG. 1 is a schematic view of a foldable crib in the prior art.

To further illustrate the examples, the accompanying drawings are provided in the disclosure. These accompanying drawings are a part of the contents disclosed in the disclosure that are mainly used to illustrate the examples, and can be used in conjunction with the related descriptions in the specification to explain the operation principle of the examples. With reference to these contents, those of ordinary skills in the art should be able to understand other possible implementations and advantages of the disclosure. Components in the drawings are not drawn to scale, and like component symbols are usually used to represent like components.

The disclosure will be further described in conjunction with the accompanying drawings and the specific implementations.

Figure 2:
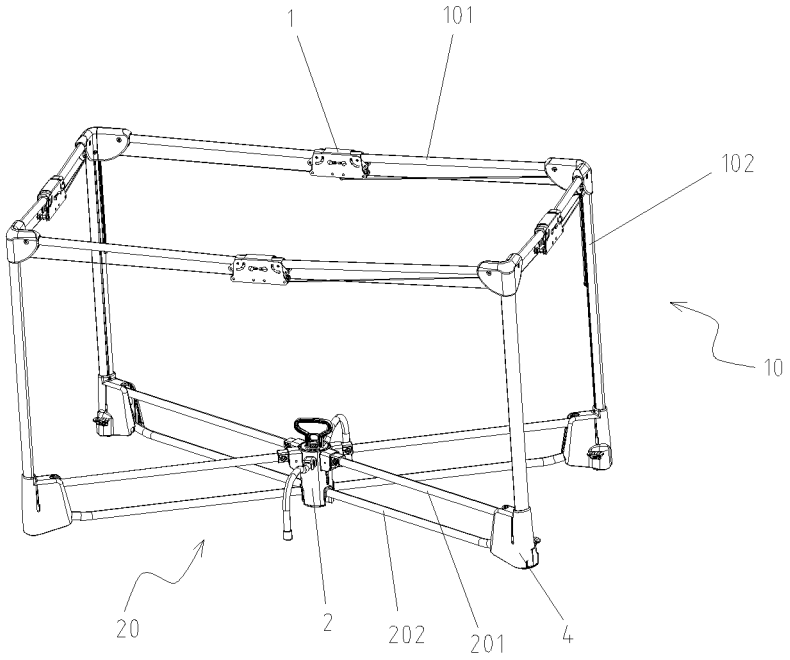
FIG. 2 is a schematic view of a foldable crib unfolded according to an example.
Figure 3:
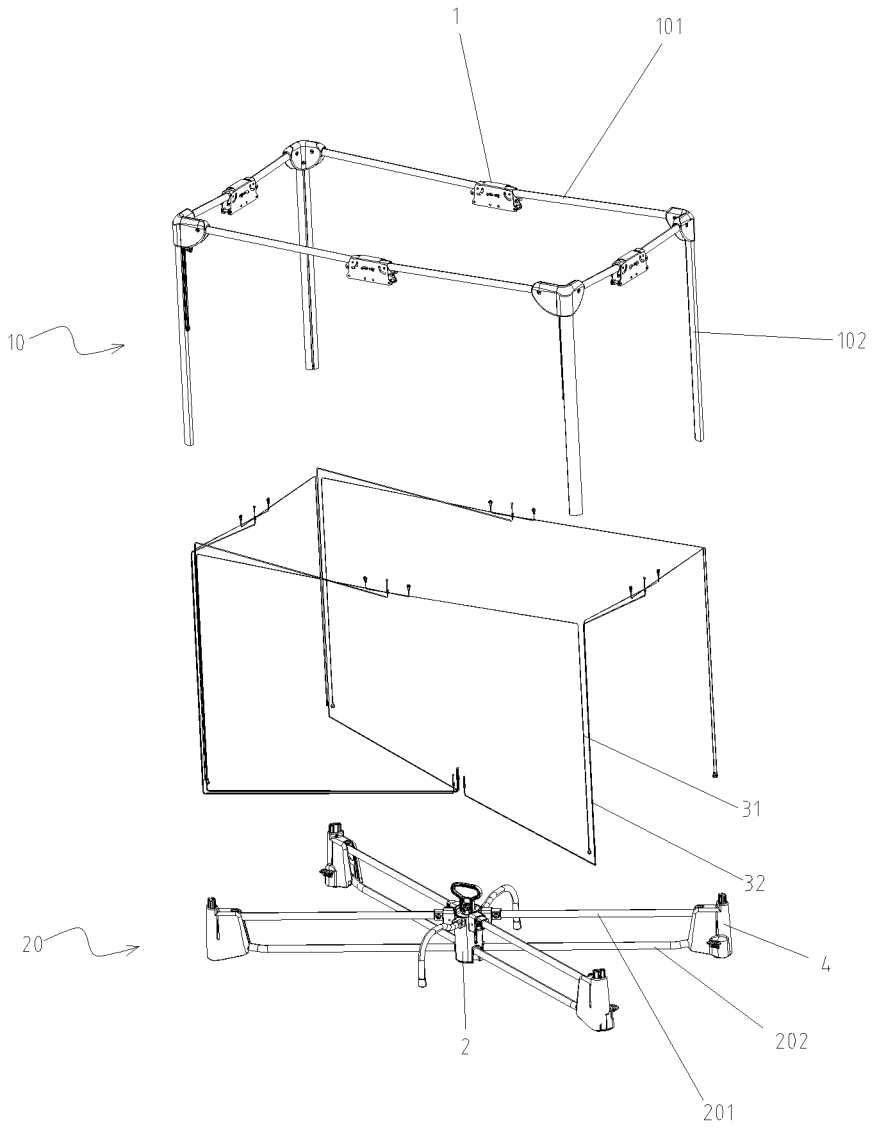
FIG. 3 is a structural exploded view of the foldable crib according to an example.

Referring to FIG. 2 to FIG. 3, a preferred example of the disclosure provides a foldable crib, including a side rail 10 and an underframe 20. In this example, the crib is described in the static orientation when it is used in an unfolded state, that is, the underframe 20 is relatively in the lower position. The side rail 10 includes a plurality of vertical bars 102 extending up and down. The vertical bars 102 are vertically connected to the underframe 20 downwards. Foldable horizontal bars 101 are each arranged between every two vertical bars 102. Two ends of the foldable horizontal bar 101 are respectively rotatably connected to one of the vertical bars 102. The underframe 20 includes a number of underframe bars 201 corresponding to the number of the vertical bars 102. Inner ends of the plurality of underframe bars 201 converge and are rotatably connected to the lifting and flipping mechanism 2, and an outer end of each of the underframe bars 201 is connected to one of the vertical bars 102 through a support 4.

Figure 4:
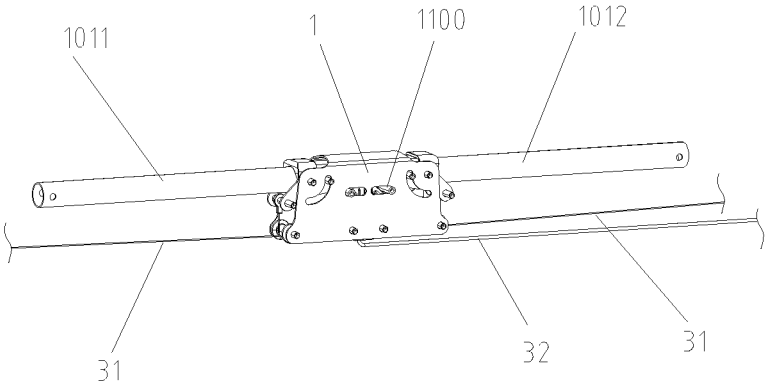
FIG. 4 is a schematic view of a folding joint according to an example.
Figure 5:
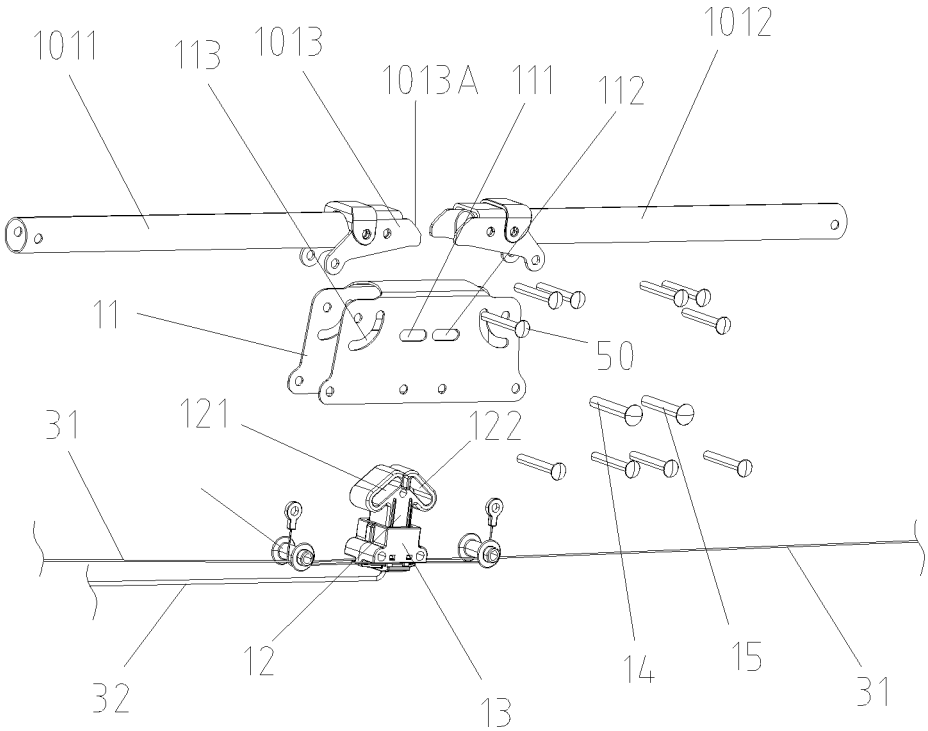
FIG. 5 is a structural schematic view of the folding joint according to an example.
Figure 6:
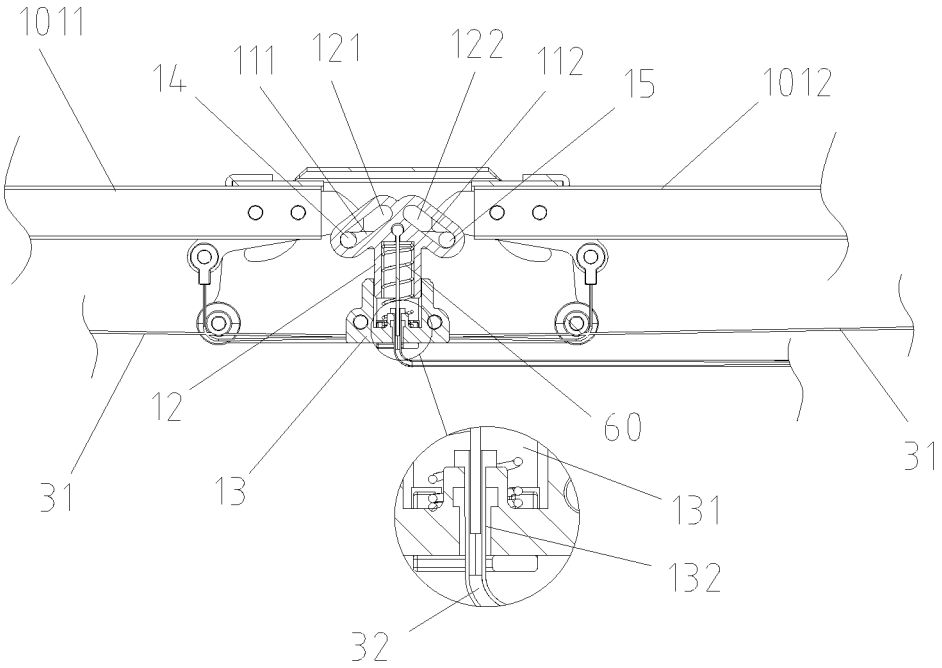
FIG. 6 is a cutaway view of the folding joint according to an example.
Figure 7:
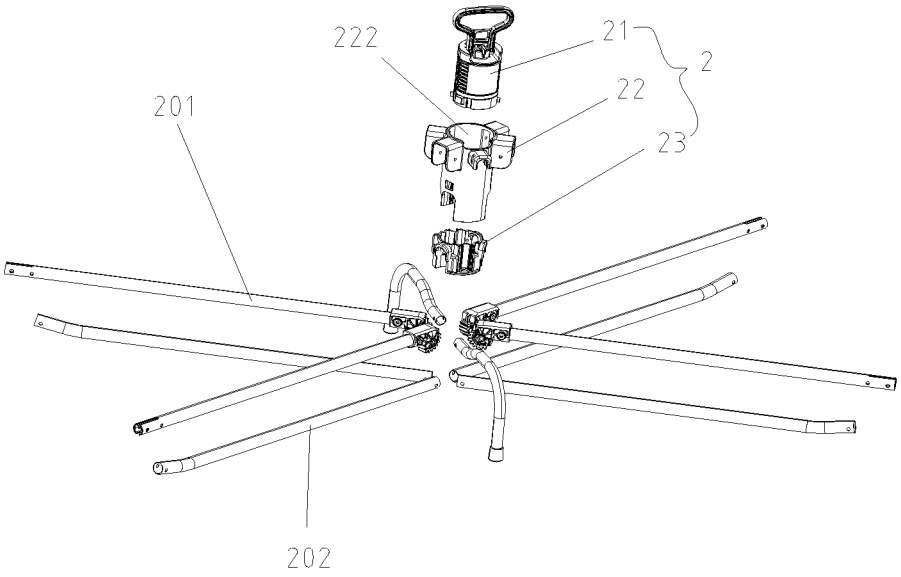
FIG. 7 is a structural exploded view of an underframe according to an example.

The structure of the foldable horizontal bar 101 is shown in FIG. 4 to FIG. 6, which includes a first folding bar 1011, a second folding bar 1012 and a folding joint 1 arranged between the first folding bar 1011 and the second folding bar 1012. The folding joint 1 includes a joint base 11. The first folding bar 1011 and the second folding bar 1012 are respectively pivoted to left and right ends of the joint base 11 so that they can pivot to unfold or fold relatively. A limiting latch 50 is further inserted in the first folding bar 1011. The limiting latch 50 is slidably fitted in an arc-shaped slot 113 arranged in the joint base 11. The limiting latch 50 abuts against two ends of the arc-shaped slot 113 so as to limit the pivoting range of the first folding bar 1011. The arc-shaped slot 113 has an arc of ninety degrees, so that the first folding bar 1011 can only pivot between a vertical extreme position (i.e., folded state) and a horizontal extreme position (i.e., unfolded state). The second folding bar 1012 has a mirror symmetry with respect to the first folding bar 1011, and thus, is connected to the joint base 11 in the same manner, which will not be described in detail.

The folding joint 1 further includes a slider 12, a guide seat 13 and a first locking mechanism 1100. The first locking mechanism 1100 is configured to synchronously lock or unlock the pivoting that cause the relative folding of the first folding bar 1011 and the second folding bar 1012. In this example, the first locking mechanism 1100 includes a first limiting pin 14 and a second limiting pin 15, and the joint base 11 is provided with a first horizontal slot 111 and a second horizontal slot 112 that extend left and right. The first horizontal slot 111 and the second horizontal slot 112 are respectively close to the first folding bar 1011 and the second folding bar 1012 and have a left-right symmetry. The guide seat 13 is fixedly connected to the joint base 11. The slider 12 is slidably connected to the guide seat 13 in the up-down direction. The slider 12 is provided with a first oblique slot 121 and a second oblique slot 122 that extend obliquely and have a left-right mirror symmetry. The first limiting pin 14 is slidably fitted in both the first horizontal slot 111 and the first oblique slot 121, and the second limiting pin 15 is slidably fitted in both the second horizontal slot 112 and the second oblique slot 122, so that the up-and-down sliding of the slider 12 is converted through the first oblique slot 121 and the second oblique slot 122 into the synchronous sliding of the first limiting pin 14 and the second limiting pin 15 away from or close to each other in the left-right direction. When the slider 12 is in a higher position, the first limiting pin 14 and the second limiting pin 15 are relatively away from each other, and the first folding bar 1011 and the second folding bar 1012 are respectively lapped on the first limiting pin 14 and the second limiting pin 15, so that the pivoting that causes the relative folding of the first folding bar 1011 and the second folding bar 1012 is resisted and locked by the first limiting pin 14 and the second limiting pin 15 (as shown in FIG. 6). Thereby, the foldable horizontal bar 101 can be kept in the unfolded state. When the slider 12 is in a lower position, the first limiting pin 14 and the second limiting pin 15 are relatively close to each other, and the first folding bar 1011 and the second folding bar 1012 are respectively out of contact with the first limiting pin 14 and the second limiting pin 15, so that the pivoting that causes the relative folding of the first folding bar 1011 and the second folding bar 1012 is unlocked.

Apparently, the slider 12 may also be directly slidably connected to the joint base 11, as long as the slider 12 has an up-and-down sliding stroke. In this example, the first oblique slot 121 and the second oblique slot 122 is used to convert the up-and-down movement of the slider 12 into the left-and-right movement of the first limiting pin 14 and the second limiting pin 15, so the structure is simple, compact and reliable. In other examples, other linkage structures may also be used to lock or unlock the first folding bar 1011 and the second folding bar 1012 by using the slider 12. For example, a connecting rod structure is used to link the first folding bar 1011 (second folding bar 1012) and the first limiting pin 14 (second limiting pin 15).

As shown in FIG. 6, in this example, a slideway 131 is arranged in the guide seat 13, and the slider 12 is slidably connected into the slideway 131. Moreover, the slideway 131 further provides an inner cavity space for mounting an elastic restoring member 60. A first end of the elastic restoring member 60 acts on the guide seat 13, and a second end of the elastic restoring member 60 acts on the slider 12, such that the slider 12 can be restored. That is, when the slider 12 moves downward, the elastic restoring member 60 accumulates energy; and after the downward force applied to the slider 12 is removed, the elastic restoring member 60 releases energy that acts on the slider 12 such that the slider is restored upward. At this time, the first limiting pin 14 and the second limiting pin 15 are also restored to relatively farther locked positions. In this example, the elastic restoring member 60 is a pressure spring. The arrangement of the elastic restoring member 60 in the slideway 131 can make the structure of the folding joint 1 more compact. In other examples, the elastic restoring member may also be arranged between the joint base 11 and the slider 12, but the material and mounting manner should be changed adaptively. For example, the elastic restoring member may be a tension spring, and the tension spring is connected to the joint base 11 and the slider 12 through pull hooks.

As shown in FIG. 5, in order to realize reliable lapping between the first folding bar 1011 and the first limiting pin 14, an end of the body of the first folding bar 1011 relatively close to the folding joint 1 is fixed with a sheet-like lap joint 1013, and an end of the lap joint 1013 has an oblique guide surface 1013A. When the crib is unfolded from the folded state, the oblique guide surface 1013A of the lap joint 1013 can push the first limiting pin 14 close to the second limiting pin 15, so that the first folding bar 1011 can be restored to its unfolded state in which it is horizontal and straight without being limited by the first limiting pin 14. The second folding bar 1012 having a mirror symmetry with the first folding bar 1011 also has the same lap joint structure.

The above contents have described the unlocking mechanism of the locking structure of the folding joint 1 in this example, i.e., the pivoting that causes the relative folding of the first folding bar 1011 and the second folding bar 1012 is locked or unlocked through the up-and-down sliding of the slider 12. That is, the downward sliding stroke of the slider 12 is the first unlocking stroke of the first locking mechanism 1100. In other examples, another movable unlocking member, such as a swing unlocking member, may also be used instead of the slider 12. The swing unlocking member controls the movement of the first limiting pin 14 and the second limiting pin 15 through a driving mode such as a connecting rod. Alternatively, the swing unlocking member and the slider 12 of this example form a swing link-slider mechanism. However, the slider 12 is better fitted with the structure of a first pull wire 32 described below, and the pull driving force of the first pull wire 32 can be converted into the downward sliding of the slider 12 more directly, which simplifies the structure of the folding joint 1 and the entire crib.

Figure 8:
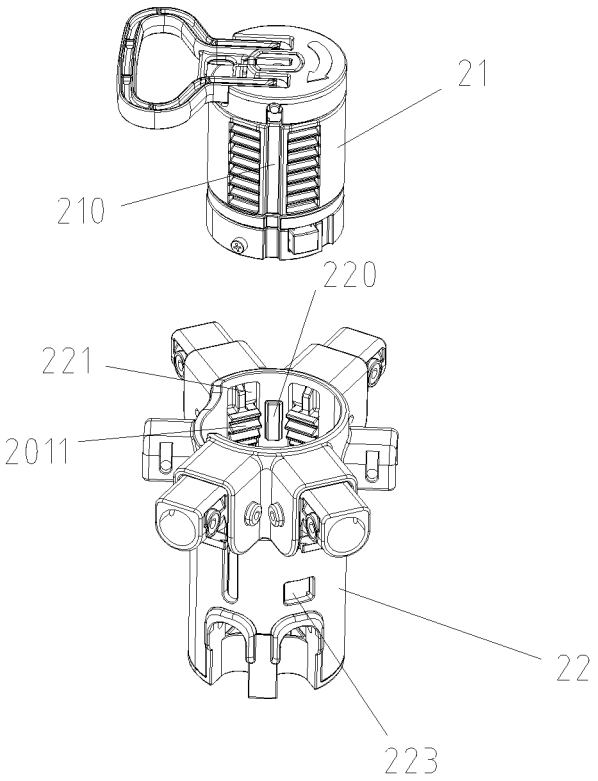
FIG. 8 is a structural exploded view of a lifting and flipping mechanism according to an example.

Referring to FIG. 7 to FIG. 11, the underframe 20 includes underframe bars 201 and a lifting and flipping mechanism 2. The lifting and flipping mechanism 2 is configured to operate the plurality of underframe bars 201 to fold or unfold. The lifting and flipping mechanism 2 further includes a pull-type combination core 21, a sleeve seat 22 and a bottom cover 23. The sleeve seat 22 is a hollow sleeve-like structure and includes a sliding sleeve cavity 222 with an axis extending vertically along an up-down direction. The pull-type combination core 21 is slidably inserted and fitted in the sliding sleeve cavity 222 in the up-down direction. As shown in FIG. 8, the pull-type combination core 21 has a sliding groove 210 extending up and down, and an inside of the sleeve seat 22 is fixedly provided with a slider 220 slidably fitted in the sliding groove 210. The underframe bars 201, every two of which are symmetrical to each other, are distributed around the sleeve seat 22. The inner end of each of the underframe bar 201 is rotatably connected to the sleeve seat 22. The bottom cover 23 is fixedly connected to a lower part of the sleeve seat 22 and seals a bottom opening of the sleeve seat 22. A number of decorative bars 202 arranged corresponding to the number of the underframe bars 201 are rotatably connected to the bottom cover 23. Since it is required to push down the lifting and flipping mechanism 2 during the unfolding process of the crib, the lifting and flipping mechanism 2 may hit against the ground, the arrangement of the bottom cover 23 helps in improving the structural strength of the lifting and flipping mechanism 2.

Figure 9:
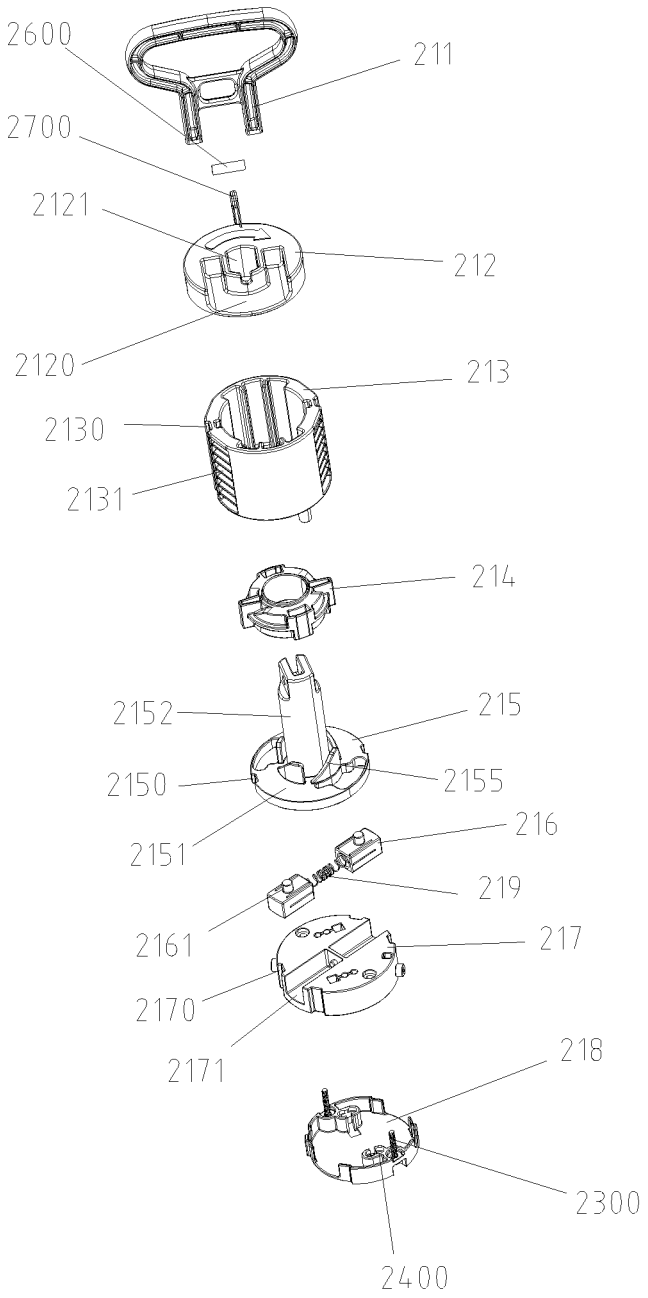
FIG. 9 is a structural exploded view of a pull-type combination core according to an example (from viewpoint I)
Figure 10:
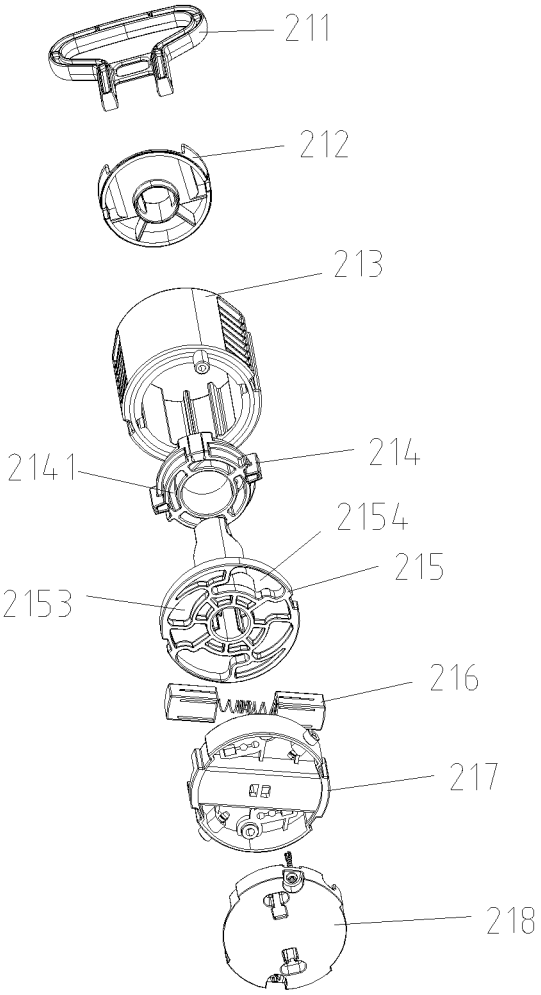
FIG. 10 is a structural exploded view of the pull-type combination core according to an example (from viewpoint II)

As shown in FIG. 9 and FIG. 10, the pull-type combination core 21 further includes a handle 211, a handle swing seat 212, a straight toothed socket 213, a handle rotating disk 215, a lockpin 216, a lockpin guide seat 217 and a lower cover 218. The handle rotating disk 215 is rotatably fitted in the sliding sleeve cavity 222 of the sleeve seat 22, so that the handle rotating disk 215 can also rotate around the vertical axis. The handle 211 is arranged on a top end of the pull-type combination core 21 to serve as a part that can be operated. The handle 211 and the handle rotating disk 215 are coaxially connected. Specifically, the handle rotating disk 215 includes a disk body 2151 and a coupling shaft 2152 fixedly connected to an upper end surface of the disk body 2151. The coupling shaft 2152 protrudes upward. The handle 211 and the coupling shaft 2152 are pin-connected. Therefore, the handle 211 can also rotate along the vertical axis.

An upper end of the coupling shaft 2152, which is trimmed and circular, is inserted into a trimmed circular hole 2121 provided in the handle swing seat 212 so as to realize a shaft-hub connection between the handle swing seat 212 and the handle rotating disk 215. While the handle 211 and the coupling shaft 2152 are pin-connected, a pin 2600 for realizing this pin connection is also rotatably connected to the handle swing seat 212. This pin 2600 is arranged horizontally, so that the handle 211 can also swing along the horizontal axis, and thereby, the handle 211 has a horizontal position and a vertical position. Moreover, the handle swing seat 212 is provided with a sink 2120 for receiving the handle 211. A first arm of a torsion spring 2700 acts on the handle swing seat 212, and a second arm of the torsion spring 2700 acts on the handle 211, so that the handle 211 can be flipped and restored. In the unfolded state, the handle 211 is horizontally received in the sink 2120 of the handle swing seat 212. To operate the handle 211, the handle 211 is flipped up first, and then the handle 211 may be pulled up or the handle 211 is rotated along the vertical axis.

The straight toothed socket 213 is a hollow tubular structure with two open ends, and a periphery of the straight toothed socket is provided with four racks 2131 extending in the up-down direction corresponding to the four underframe bars 201. In this example, the racks 2131 are concave sawtooth groove structures on the periphery of the straight toothed socket 213. In other examples, the racks 2131 may also be convexly arranged on a wall surface of the periphery of the straight toothed socket 213, but in this case, an inner wall of the sleeve seat 22 needs to be provided with structures for avoiding the racks 2131. The coupling shaft 2152 of the handle rotating disk 215 runs upward through the straight toothed socket 213. The lockpin guide seat 217 is arranged on a lower end of the handle rotating disk 215, and the lower cover 218 is arranged on a lower end of the lockpin guide seat 217. The lower cover 218, the lockpin guide seat 217 and the straight toothed socket 213 are fixed and connected together through a screw 2300. The disk body 2151 of the handle rotating disk 215 is clamped between the straight toothed socket 213 and the lockpin guide seat 217. The handle rotating disk 215 is provided with an avoidance groove 2154 for avoiding the screw 2300. The handle 211 is pulled such that the entire pull-type combination core 21 is pulled to rise in the sliding sleeve cavity 222 of the sleeve seat 22, or the pull-type combination core 21 can be pushed down such that the pull-type combination core 21 falls in the sliding sleeve cavity 222 of the sleeve seat 22. Straight grooves 2130, 2150, 2170 respectively provided on the peripheries of the straight toothed socket 213, the handle rotating disk 215 and the lockpin guide seat 217 are combined to form the sliding groove 210.

Figure 11:
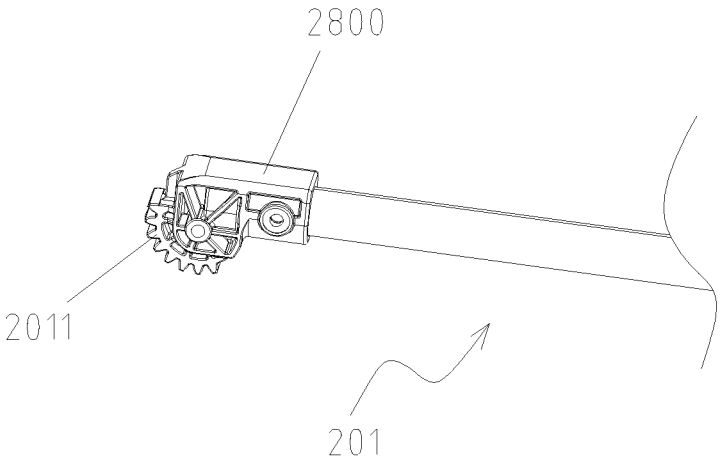
FIG. 11 is a schematic view of an inner end of an underframe bar according to an example.
Figure 12:
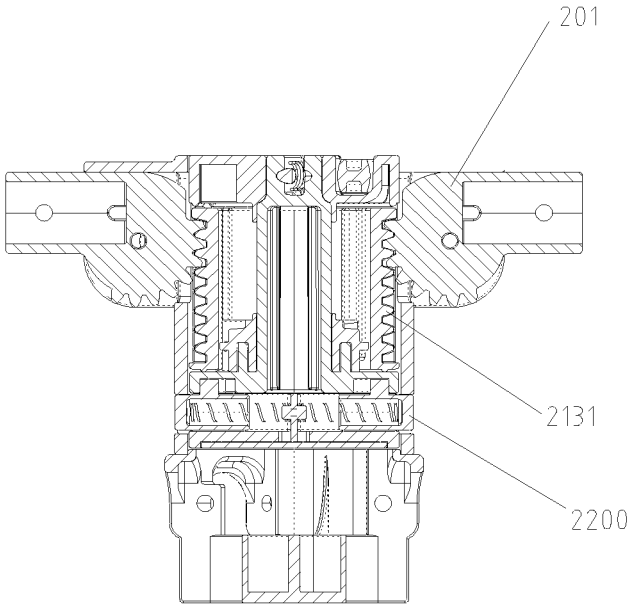
FIG. 12 is a cutaway view of the lifting and flipping mechanism according to an example (underframe unfolded)
Figure 13:
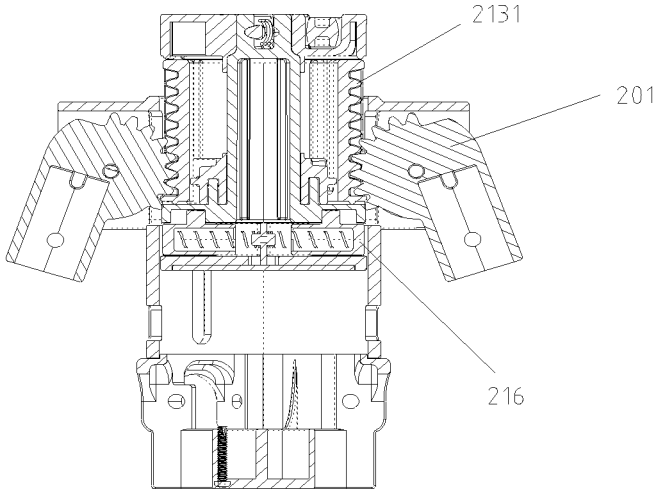
FIG. 13 is a cutaway view of the lifting and flipping mechanism according to an example (underframe folded)

As shown in FIG. 11, the inner end of the underframe bar 201 is fixedly connected with an arc-shaped toothed portion 2011. The arc-shaped toothed portion 2011 is in the shape of an incomplete gear with a plurality of teeth arranged along an arc. The arc-shaped toothed portion 2011 is specifically arranged on a sleeve head 2800. The sleeve head 2800 is fixedly sleeved on the inner end of the underframe bar 201. As shown in FIG. 8, the sleeve seat 22 is provided with a window 221, and the arc-shaped toothed portion 2011 of the underframe bar 201 which is rotatably connected to the sleeve seat 22 extends into an inner cavity of the sleeve seat 22 via the window 221 and correspondingly engages with the rack 2131. As shown in FIG. 12 and FIG. 13, when the pull-type combination core 21 (straight toothed socket 213) rises, gearing between the arc-shaped toothed portion 2011 and the rack 2131 drives the underframe bars 201 to fold. When the pull-type combination core 21 (straight toothed socket 213) falls, the gearing between the arc-shaped toothed portion 2011 and the rack 2131 drives the underframe bars 201 to unfold to the horizontal position. In this example, the connection between the lifting and flipping mechanism 2 and the underframe bar 201 is realized by gear engagement, so that the lifting and flipping mechanism 2 and the underframe bars 201 have a gearing linkage relationship. In particular, when the crib is in the folded state, as the lifting and flipping mechanism 2 and the pull-type combination core 21 are pushed down, under the action of the gearing between the arc-shaped toothed portion 2011 and the rack 2131, torque of the lifting and flipping mechanism 2 is transferred to the underframe bars 201. Once the pull-type combination core 21 falls to the proper position in the sliding sleeve cavity 222, the underframe bars 201 under the action of the gear engagement will be kept in the horizontal unfolded state.

The lockpin guide seat 217 closely arranged on a lower end of the handle rotating disk 215 is provided with a straight guide groove 2171 extending horizontally, and the lockpin 216 is slidably fitted in the straight guide groove 2171. An upper end of the lockpin 216 is fixedly provided with a guide post 2161, and the lower end of the handle rotating disk 215 is provided with an arc-shaped guide groove 2153. An outer edge of the arc-shaped guide groove 2153 is in the shape of an arc that gradually bends from a radial outer end toward a radial inner end of the handle rotating disk 215, and the guide post 2161 is inserted in the arc-shaped guide groove 2153. A first end of an elastic restoring member 219 acts on the lockpin guide seat 217, and a second end of the elastic restoring member 219 acts on the lockpin 216 such that the lockpin 216 has a tendency to move radially outward. The sleeve seat 22 is provided with a lockhole 223. When the lifting and flipping mechanism 2 is locked, the lockpin 216 is inserted in the lockhole 223, so that the pull-type combination core 21 cannot slide in the sleeve seat 22, i.e., the underframe bars 201 cannot be folded. After the handle 211 is rotated along the vertical axis, the outer edge of the arc-shaped guide groove 2153 of the handle rotating disk 215 pushes the lockpin 216 to move radially inward and to leave the lockhole 223. At this time, the lifting and flipping mechanism 2 is unlocked, and then the handle 211 is pulled up to pull the entire pull-type combination core 21, so that the underframe bars 201 are folded.

The handle rotating disk 215, the lockpin guide seat 217, the lockpin 216, the elastic restoring member 219 and the lockhole 223 form a second locking mechanism 2200 for locking the lifting and flipping mechanism 2. The lifting and flipping mechanism 2 may be unlocked by rotating the handle 211 on the vertical axis, that is, the rotation stroke of the handle 211 on the vertical axis is a second unlocking stroke of the second locking mechanism 2200.

In this example, a linkage mechanism is further arranged between the lifting and flipping mechanism 2 and the folding joint 1, so that the movements of the lifting and flipping mechanism 2 and the folding joint 1 can be linked together. The linkage mechanism specifically includes a first linkage structure (the first linkage structure is a first pull wire 32) and a second linkage structure (the second linkage structure includes a rotary linkage member 43 and a second pull wire 31). The first linkage structure is configured to link the handle 211 to the slider 12, so that the second unlocking stroke of the handle 211 is capable of causing a first unlocking stroke of the slider 12, i.e., while the lifting and flipping mechanism 2 is unlocked, the folding joint 1 is also unlocked. The second linkage structure is configured to link the underframe bars 201 to the foldable horizontal bars 101, so that while the underframe bars 201 are unfolded, the foldable horizontal bars 101 are also unfolded.

The first linkage structure in this example is the first pull wire 32. An upper end of the first pull wire 32 is connected to the slider 12, and a lower end of the first pull wire 32 extends into the lifting and flipping mechanism 2 and is linked to the handle 211, so that the rotation of the handle 211 can cause the slider 12 to slide. In this example, the first pull wire 32 is arranged from an upper end to a lower end sequentially along the foldable horizontal bar 101, the vertical bar 102 and the decorative bar 202. The decorative bar 202 is rotatably connected to the bottom cover 23 around a hinge point that is lower than a hinge point of the underframe bar 201 and the sleeve seat 22. Both the vertical bar 102 and the decorative bar 202 are hollow structures, and the first pull wire 32 runs inside the bodies of the vertical bar 102 and the decorative bar 202. The lower end of the first pull wire 32 running out of the decorative bar 202 in a lower position extends upward into the lifting and flipping mechanism 2 and is linked with the handle 211. In terms of the linkage between the lower end of the first pull wire 32 and the handle 211, the lower end of the first pull wire 32 may be directly fixed to the handle 211, so that the rotation of the handle 211 can directly pull the first pull wire 32, but in this example, the linkage between the handle 211 and the lower end of the first pull wire 32 is realized by another solution. As shown in FIG. 9, a lifting sleeve 214 is further included in the pull-type combination core 21. The lifting sleeve 214 is sleeved on the coupling shaft 2152 and located in an inner cavity of the straight toothed socket 213. The disk body 2151 is provided with a first slope 2155. The lifting sleeve 214 is provided with a second slope 2141. The first slope 2155 and the second slope 2141 abut against each other to form a slope guide fit, so that when the disk body 2151 rotates, the lifting sleeve 214 is lifted through the slope guide fit between the first slope 2155 and the second slope 2141 or the lifting sleeve 214 naturally falls by its gravity. The lower end of the first pull wire 32 is fixedly connected to the lifting sleeve 214, so that the handle 211 pulls up the first pull wire 32 in a larger stroke. The structures of the lifting and flipping mechanism 2, such as the lockpin guide seat 217, the lower cover 218 and the disk body 2151, are provided with wire holes (e.g., wire holes 2400 in the lower cover 218) for the lower end of the first pull wire 32 to run through.

As shown in FIG. 6, the slider 12 and the guide seat 13 are aligned in the up-down direction. The guide seat 13 is provided with a guide channel 132. In this example, the guide channel 132 is only a vertical channel extending vertically in the up-down direction, and the first pull wire 32 runs through the guide channel 132 such that the upper end of the first pull wire 32 extends vertically in the up-down direction. No matter how the first pull wire 32 extends, the upper end of the first pull wire connected to the slider 12 will necessarily be vertical in the up-down direction after running through the guide channel 132. Therefore, when the first pull wire 32 is pulled, the force applied to the slider 12 by the upper end of the first pull wire 32 is vertically downward without components in other directions, so that the first pull wire 32 can pull the slider 12 reliably. Moreover, it is worth noting that since the guide channel 132 is a tunnel-like structure, the guide channel 132 can also limit the first pull wire 32, so as to prevent the first pull wire 32 from getting entangled with other components due to wobbling, stretching and other factors.

In this example, the first pull wire 32 runs from an upper end through the guide channel 132, and then bends and extends along the left-right direction. In other examples, an arc-shaped channel having an arc of ninety degrees may be further connected to a lower part of the guide channel 132, and the first pull wire 32 may run from the upper end through the guide channel 132, and then run through the arc-shaped channel so as to be guided to extend in the left-right direction, so that the direction of the first pull wire 32 at the bend will not deviate.

Figure 14:
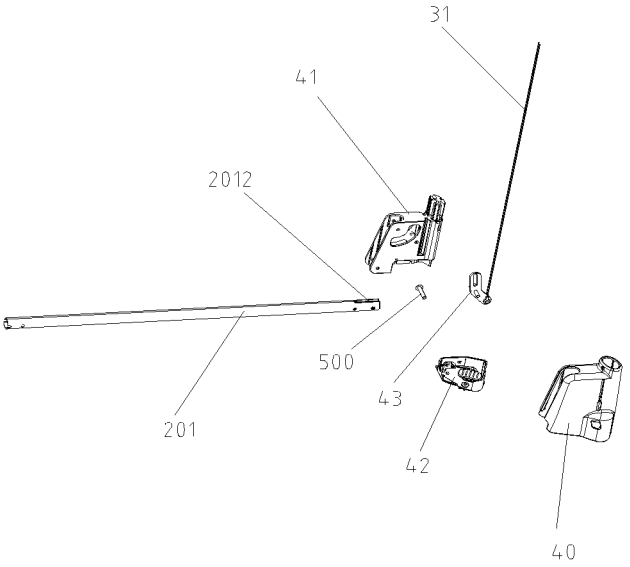
FIG. 14 is a schematic view of an underframe bar, a support, a second pull wire and a rotary linkage member according to an example.

The second linkage structure in this example includes a rotary linkage member 43 and a second pull wire 31. As shown in FIG. 14, referring to FIG. 3 and FIG. 6, the support 4 includes a casing 40, a brake caster 42 and a support body 41. The casing 40 is fixedly connected to an outer side of the support body 41. The brake caster 42 is fixedly connected to the support body 41. The rotary linkage member 43 is rotatably connected to the support body 41. The outer end of the underframe bar 201 is rotatably connected to the support body 41, so that the underframe bar 201 can flip between a vertical extreme position and a horizontal extreme position with respect to the support body 41 (around the center of rotation of point E). The underframe bar 201 and the support body 41 may be fitted in a manner similar to that of the limiting latch 50 and the arc-shaped slot 113 to limit the rotating range of the underframe bar 201. The rotary linkage member 43 of this example is a sheet-like structure that bends and extends at an obtuse angle. The rotary linkage member 3 is hinged with the support body 41 (around a hinge point of point F. A first connecting portion 432 and a second connecting portion 431 are respectively arranged on two sides of the hinge point of the rotary linkage member 43 and the support body 41. The first connecting portion 432 is configured to fix the lower end of the second pull wire 31. In this example, the first connecting portion 432 is a through hole, which is fixed to the lower end of the second pull wire 31 through a latch structure. The second connecting portion 431 is a strip groove. One end of the underframe bar 201 is hinged in the second connecting portion 431. Specifically, the outer end of the underframe bar 201 is provided with a U-shaped notch 2012, and an axis pin 500 is fixed and inserted in the U-shaped notch 2012. The rotary linkage member 43 is inserted into the U-shaped notch 2012, and the axis pin 500 runs through the second connecting portion 431.

Figure 15:
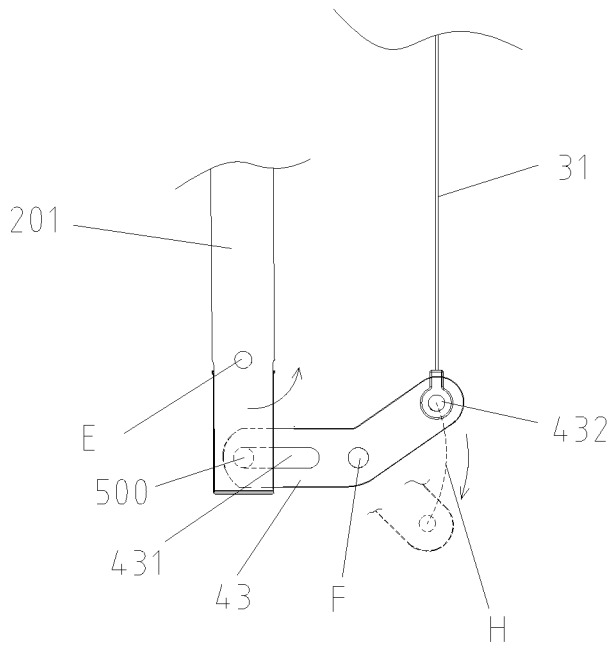
FIG. 15 is a schematic view showing the linkage between the underframe bar and the rotary linkage member when the underframe bar is in a vertical extreme position according to an example.
Figure 16:
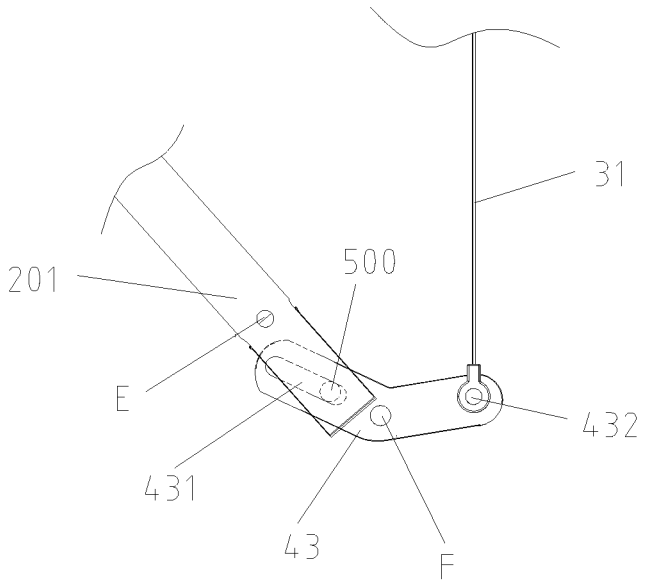
FIG. 16 is a schematic view showing the linkage between the underframe bar and the rotary linkage member when the underframe bar is in an inclined position between vertical and horizontal positions according to an example.
Figure 17:
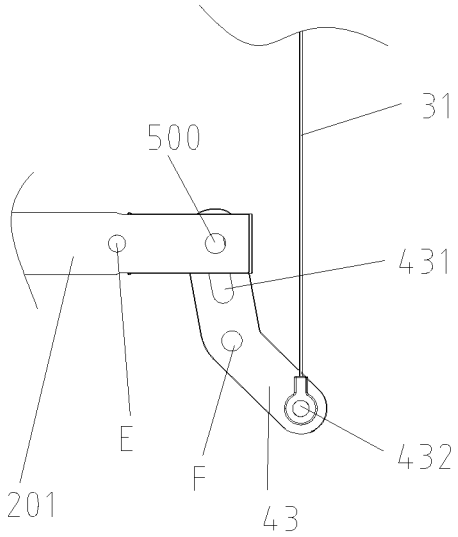
FIG. 17 is a schematic view showing the linkage between the underframe bar and the rotary linkage member when the underframe bar is in a horizontal extreme position according to an example.

In this way, the underframe bar 201 and the rotary linkage member 43 are linked through movable hinging formed by the axis pin 500 and the second connecting portion 431. The underframe bar and the rotary linkage member can move relatively and also rotate relatively. As shown in FIG. 15 to FIG. 17, the rotary linkage member 43 in this example is configured such that when the underframe bar 201 is in the vertical extreme position, the strip groove of the first connecting portion 432 extends horizontally, the axis pin 500 abuts against an end of the strip groove of the first connecting portion 432 away from the hinge point F, and the strip groove of the first connecting portion 432 provides a horizontal displacement space for the outer end of the underframe bar 201. In this case, when the underframe bar 201 flips from the vertical position to the horizontal position, there is no dead point for the rotary linkage member 43. In other words, the underframe bar 201 can be folded to the vertical extreme position, so that the crib can be folded to a smaller size and occupy less space. If this beneficial effect is not taken into consideration, in other examples, the rotary linkage member 43 may also be replaced with a conventional connecting rod structure. In other examples, the axis pin 500 may not necessarily abut against the end of the strip groove of the first connecting portion 432 away from the hinge point F, for example, the axis pin 500 may be in the middle of the strip groove of the first connecting portion 432. Nevertheless, the axis pin 500 abutting against the end of the strip groove of the first connecting portion 432 away from the hinge point F in this example can also limit the underframe bar 201.

Moreover, in this example, the rotary linkage member 43 is a structure that bends and extends at an obtuse angle, and the hinge point F is arranged at the bend of the rotary linkage member 3. In this way, as shown in FIG. 15, the motion path H of the first connecting portion 432 is basically in the vertical direction (the motion path H is generally in the vertical direction), so that the second pull wire 31 will not be pushed too much in the horizontal direction, thereby avoiding friction and interference of the second pull wire 31 with other structures.

The upper end of the second pull wire 31 is fixedly connected to the first folding bar 1011 or the second folding bar 1012 (the first folding bar 1011 or the second folding bar 1012 is each provided with a second pull wire 31). The second pull wire 31 extends from an upper end along the foldable horizontal bar 101 in the left-right direction and then extends vertically downward along the vertical bar 102 to the support 4. The second pull wire 31 runs inside the vertical bar 102. When the underframe bar 201 is unfolded, the second pull wire 31 is pulled by the rotary linkage member 43, so that the second pull wire 31 pulls the first folding bar 1011 and the second folding bar 1012 to be unfolded, and thereby, the foldable horizontal bar 101 is straightened into the locked state.

The first pull wire 32 and the second pull wire 31 may also be replaced with other linear drive structures. For example, each line segment of the pull wire is replaced with a rigid straight bar, and each bend segment of the pull wire is replaced with a connecting rod/rotary table linkage structure. That is, a plurality of the rigid straight bars are connected in sequence, and the connecting rod/rotary table linkage structures are arranged at the joints to link the pulling forces. This structure is also feasible, but the crib with this structure is not as easy to fold as that with the flexible pull wires. Moreover, the crib with this structure is heavier.

Figure 18:
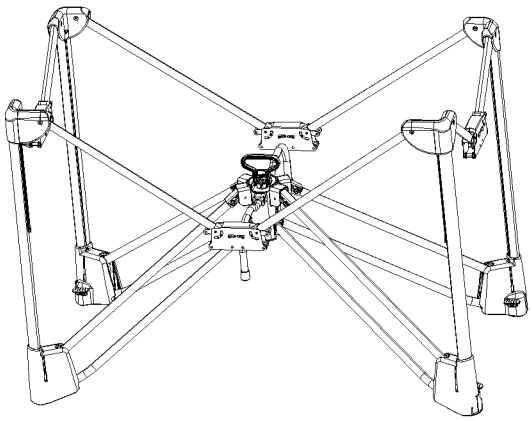
FIG. 18 is a schematic view of the foldable crib half-folded according to an example.
Figure 19:
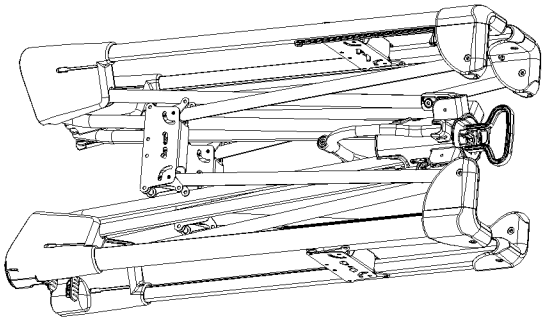
FIG. 19 is a schematic view of the foldable crib completely folded according to an example.

Referring to FIG. 2, FIG. 18 and FIG. 19, the folding and unfolding principles of this example are as follows:

1. Folding process: When the crib is in the unfolded state, both the folding joint 1 and the lifting and flipping mechanism 2 are in the locked state, and the underframe bars 201 and the foldable horizontal bars 101 are all horizontal. The handle 211 is manually rotated such that the handle 211 unlocks the second locking mechanism 2200, and at the same time, the slider 12 is pulled by the first pull wire 32 to unlock the first locking mechanism 1100. At this time, the folding joint 1 is unlocked, and the foldable horizontal bars 101 change from the locked state (in which they are horizontal and straight) into a loose unlocked state (in which they are depressed and bent downward) under the action of gravity. The handle 211 is lifted, so that the gearing between the arc-shaped toothed portion 2011 and the rack 2131 drives the underframe bars 201 to flip and fold downward. At the same time, the vertical bars 102 are pulled close to the center, so that the foldable horizontal bars 101 are further folded.

2. Unfolding process: When the crib is in the folded state, the handle 211 is pushed down, so that the gearing between the arc-shaped toothed portion 2011 and the rack 2131 drives the underframe bars 201 to unfold. At the same time, the underframe bars 201 pull the second pull wire 31 through the rotary linkage member 43, so that the second pull wire 31 pulls the first folding bar 1011 and the second folding bar 1012, and thereby the foldable horizontal bar 101 is straightened into the locked state.

According to the foldable crib of this example, with the first linkage structure and the second linkage structure, the unfolding and the folding of the foldable crib can be completed by only operating the lifting and flipping mechanism 2, and there is no need to operate the folding joint 1. Therefore, the foldable crib can be unfolded or folded in one step, thereby greatly simplifying the manual operation for the crib. During the folding process, with the linkage of the first pull wire 32, the folding joint 1 and the lifting and flipping mechanism 2 can be unlocked synchronously only by rotating the handle 211. During the unfolding process, with the linkage of the gear-rack structure formed by the arc-shaped toothed portion 2011 and the rack 2131, the second pull wire 31 and the rotary linkage member 43, the underframe bars 201 and the foldable horizontal bars 101 can be synchronously unfolded reliably.

Although the disclosure has been specifically shown and described in connection with the preferred implementations, it should be understood by those skilled in the art that various changes made thereto in forms and details without departing from the spirit and scope of the disclosure as defined in the appended claims shall fall within the scope of protection of the disclosure.

The invention claimed is:

1. A foldable crib, comprising a side rail and an underframe, the side rail comprising foldable horizontal bars, the foldable horizontal bars having a first locking mechanism, the first locking mechanism being configured to lock a folding action of the foldable horizontal bars when the foldable crib is unfolded, the underframe comprising a lifting and flipping mechanism, the lifting and flipping mechanism having a second locking mechanism, and the second locking mechanism being configured to lock a folding action of the lifting and flipping mechanism when the foldable crib is unfolded; wherein the foldable horizontal bars further comprise a movable unlocking member configured to slide in a vertical direction for unlocking the first locking mechanism; the lifting and flipping mechanism further comprises a handle configured to rotate on a vertical axis for unlocking the second locking mechanism; and the foldable crib further comprises a first linkage structure, the handle being linked with the movable unlocking member through the first linkage structure such that a rotation on the vertical axis of the handle is configured to cause a sliding in the vertical direction of the movable unlocking member.

2. The foldable crib according to claim 1, wherein the side rail further comprises a plurality of vertical bars, each of the foldable horizontal bars being arranged between a first one of the plurality of vertical bars and a second one of the plurality of vertical bars, and two ends of the foldable horizontal bars being respectively rotatably connected to the first one of the plurality of vertical bars; and the underframe further comprises a number of underframe bars corresponding to a number of the plurality of vertical bars, inner ends of the underframe bars converging and being rotatably connected to the lifting and flipping mechanism, and a lower end of each of the plurality of vertical bars being connected to an outer end of one of the underframe bars.

3. The foldable crib according to claim 2, wherein the first linkage structure is a first pull wire, the first pull wire is linked with the movable unlocking member and the handle.

4. The foldable crib according to claim 3, wherein the lifting and flipping mechanism further comprises a sleeve seat and a handle rotating disk, wherein the sleeve seat is a hollow sleeve-like structure and comprises a sliding sleeve cavity with an axis extending vertically along the vertical direction, the underframe bars being rotatably connected to the sleeve seat; and the handle rotating disk is rotatably fitted in the sliding sleeve cavity, and the handle rotating disk and the handle are coaxially connected such that the handle is rotatable along the vertical axis.

5. The foldable crib according to claim 4, wherein the second locking mechanism comprises a lockpin, a lockpin guide seat and an elastic restoring member, wherein the lockpin guide seat is closely arranged to a lower end of the handle rotating disk, and the lockpin guide seat is provided with a straight guide groove extending horizontally; the lockpin is slidably fitted in the straight guide groove; an upper end of the lockpin is fixedly provided with a guide post, and the lower end of the handle rotating disk is provided with an arc-shaped guide groove; an outer edge of the arc-shaped guide groove is in a shape of an arc that gradually bends from a radial outer end toward a radial inner end of the handle rotating disk, and the guide post is inserted in the arc-shaped guide groove; a first end of the elastic restoring member acts on the lockpin guide seat, and a second end of the elastic restoring member acts on the lockpin such that the lockpin is biased to move radially outward; and the sleeve seat is provided with a lockhole, the lockpin is configured to be inserted into the lockpin.

6. The foldable crib according to claim 4, wherein a lower end of the first pull wire is fixedly connected to at least one of the handle or the handle rotating disk; the handle rotating disk comprises a disk body and a coupling shaft fixed to a top surface of the disk body, the handle and the disk body being coaxially connected through the coupling shaft, the coupling shaft being sleeved with a lifting sleeve, the disk body being provided with a first slope, the lifting sleeve being provided with a second slope, the first slope and the second slope abutting against each other to form a slope guide fit such that the lifting sleeve is lifted through the slope guide fit between the first slope and the second slope when the disk body rotates, and the lower end of the first pull wire being fixedly connected to the lifting sleeve.

7. The foldable crib according to claim 3, wherein the foldable horizontal bars comprises a first folding bar, a second folding bar and a folding joint arranged between the first folding bar and the second folding bar, the folding joint comprising a joint base, the first folding bar and the second folding bar being respectively pivoted to left and right ends of the joint base, the movable unlocking member being a slider arranged between the first folding bar and the second folding bar and configured to slide up and down, and an upper end of the first pull wire being fixedly connected to the slider.

8. The foldable crib according to claim 7, wherein the first locking mechanism comprises a first limiting pin and a second limiting pin, and the joint base is provided with a first horizontal slot and a second horizontal slot that extend left and right respectively; the first horizontal slot and the second horizontal slot are respectively close to the first folding bar and the second folding bar and have a left-right symmetry; the slider is provided with a first oblique slot and a second oblique slot that extend obliquely and have a left-right mirror symmetry; the first limiting pin is slidably fitted in both the first horizontal slot and the first oblique slot, and the second limiting pin is slidably fitted in both the second horizontal slot and the second oblique slot, so that up-and-down sliding of the slider is converted through the first oblique slot and the second oblique slot into synchronous sliding of the first limiting pin and the second limiting pin away from or close to each other in a left-right direction; and the first limiting pin and the second limiting pin are configured to resist and lock relative folding of the first folding bar and the second folding bar.

9. The foldable crib according to claim 2, further comprising a second linkage structure, wherein the second linkage structure is configured to link the foldable horizontal bars to be unfolded when the underframe bars are unfolded.

10. The foldable crib according to claim 9, wherein the foldable horizontal bars comprise a first folding bar, a second folding bar and a folding joint arranged between the first folding bar and the second folding bar; the second linkage structure comprises a rotary linkage member and a second pull wire; the rotary linkage member is rotatably arranged on an outer end of the underframe bars; the second pull wire is arranged from an upper end to a lower end sequentially along the foldable horizontal bars and the plurality of vertical bars; and the upper end of the second pull wire is connected to the first folding bar or the second folding bar, and the lower end of the second pull wire is fixedly connected to the rotary linkage member, so that when the underframe bars are unfolded, the second pull wire is pulled by the rotary linkage member so as to pull the first folding bar and the second folding bar to be unfolded.

11. The foldable crib according to claim 10, further comprising supports each fixedly connected to the lower end of the plurality of vertical bars, wherein the underframe bars are rotatably connected to the supports and configured to flip between a vertical extreme position and a horizontal extreme position with respect to the supports; the rotary linkage member is hinged with the supports; and a first connecting portion and a second connecting portion are respectively arranged on two sides of a hinge point of the rotary linkage member and the supports, the first connecting portion being configured to fix the lower end of the second pull wire, the second connecting portion being a strip groove, and the outer end of the underframe bars being hinged in the strip groove.

12. The foldable crib according to claim 10, wherein the lifting and flipping mechanism further comprises a pull-type combination core and a sleeve seat, wherein the sleeve seat is a hollow sleeve-like structure and comprises a sliding sleeve cavity with an axis extending vertically along the vertical direction, and the pull-type combination core is slidably inserted and fitted in the sliding sleeve cavity in the vertical direction; the handle is arranged on a top end of the pull-type combination core; a peripheral side of the pull-type combination core is provided with a number of racks extending in the vertical direction corresponding to a number of the underframe bars; the inner ends of the underframe bars are fixedly connected with an arc-shaped toothed portion; the sleeve seat is provided with a window, and the underframe bars are rotatably connected to the sleeve seat; and the arc-shaped toothed portion of the underframe bars extends into an inner cavity of the sleeve seat via the window and correspondingly engages with the racks.

13. The foldable crib according to claim 12, wherein the pull-type combination core comprises a straight toothed socket, a handle rotating disk, a lockpin guide seat and a lower cover; wherein the handle rotating disk is rotatably fitted in the sliding sleeve cavity; the handle rotating disk comprises a disk body and a coupling shaft fixed to a top surface of the disk body, the handle and the disk body being coaxially connected through the coupling shaft; the straight toothed socket is a hollow tubular structure with two open ends; the coupling shaft runs through the straight toothed socket; the lockpin guide seat is arranged on a lower end of the handle rotating disk; the lower cover is arranged on a lower end of the lockpin guide seat; the straight toothed socket, the lockpin guide seat and the lower cover are fixed and connected through a screw; the handle rotating disk is provided with an avoidance groove for the screw to pass through; and the racks are fixedly arranged on a periphery of the straight toothed socket.

* * * * *